US008967132B1

(12) United States Patent
Tseng

(10) Patent No.: US 8,967,132 B1
(45) Date of Patent: Mar. 3, 2015

(54) LONG-RANGE LIFEBUOY LAUNCHER

(71) Applicant: STARJET Technologies Co., Ltd, Jintan, Jiangsu (CN)

(72) Inventor: Jui-Fu Tseng, Yilan (TW)

(73) Assignee: STARJET Technologies Co., Ltd, Jintan (CN)

( * ) Notice: Subject to any disclaimer, the term of this patent is extended or adjusted under 35 U.S.C. 154(b) by 0 days.

(21) Appl. No.: 14/133,609

(22) Filed: Dec. 18, 2013

(51) Int. Cl.

| | |
|---|---|
| ***F41B 11/00*** | (2013.01) |
| ***B63C 9/22*** | (2006.01) |
| ***B63C 9/19*** | (2006.01) |
| ***F41B 11/62*** | (2013.01) |
| *B63C 9/00* | (2006.01) |

(52) U.S. Cl.
CPC ... *B63C 9/22* (2013.01); *B63C 9/19* (2013.01); *F41B 11/62* (2013.01); *B63C 2009/0029* (2013.01)
USPC ..... 124/71

(58) Field of Classification Search
CPC ..... F41B 11/62; F41B 11/00; F41B 11/83; F41B 11/89; F41B 11/68
USPC ..... 124/56–77
See application file for complete search history.

(56) References Cited

U.S. PATENT DOCUMENTS

| | | | | |
|---|---|---|---|---|
| 2,375,314 | A * | 5/1945 | Mills | 124/57 |
| 3,830,214 | A * | 8/1974 | Curtis | 124/57 |
| 2013/0239937 | A1* | 9/2013 | Macri et al. | 124/56 |
| 2013/0247892 | A1* | 9/2013 | Blackman et al. | 124/71 |

* cited by examiner

*Primary Examiner* — Samir Abdosh

(57) ABSTRACT

A compressed air powered long-range life saving device is provided. Compressed air in an air canister flows to project a tube, a rope within the tube extends to unfasten a safety pin, a sliding disc pushes down a first needle until stopped, the first needle punctures an auxiliary air canister to release compressed air, the compressed air enters a receptacle, the compressed air flows out of the receptacle into a first portion of a second cylinder, the second needle is pushed down when the pressure reaches a preset value, the second needle punctures a main air canister to release compressed air prior to entering a second portion of the second cylinder, the compressed air flows out of the second portion into the first cylinder, the compressed air flows into the a lifebuoy for inflation, the inflated lifebuoy separates a housing into two pieces, and the rope unwinds.

1 Claim, 16 Drawing Sheets

LONG-RANGE LIFEBUOY LAUNCHER

BACKGROUND OF THE INVENTION

1. Field of the Invention

The invention relates to life saving devices and more particularly to a compressed air powered device for launching a lifebuoy from long-range to save a person overwhelmed in water.

2. Description of Related Art

A conventional life saving device having a launcher is provided for an automatic inflation of a float by simply acting on a lever. The mechanism comprises an air canister at a top portion with the float so that the canister is traversed by a hollow cut-off cock whose lower end projects from a container and is terminated by the lever. The upper end is introduced inside the float and the air penetrating through the hollow tube of the cock. Integral with the assembly is a ring connected to a rolled-up cable which is integrally formed with the launcher. The launcher is mounted in a gun so that a life saving assembly can be launched toward a target in danger.

While it has some utility, improvements in these products are desired, and these improvements are provided by the invention.

SUMMARY OF THE INVENTION

It is therefore one object of the invention to provide a life saving device comprising a housing consisting of at least two detachable pieces and comprising a neck having an opening; a cylindrical cap assembly comprising an annular groove on an outer surface, a hollow extension, a stop member secured to an opening of the extension, a transverse hole through the extension, a safety pin inserted through the transverse hole, and a spring biased sliding disc having one end secured to the stop member and an other end urging against the safety pin; a first needle moveably disposed in the cap assembly and comprising an annular first flange proximate to the safety pin; a buoyant assembly disposed in the housing and comprising a hollow first cylinder having a top secured to the opening of the neck and including an inflatable lifebuoy disposed around the first cylinder; a tubular member being in fluid communication with both the first cylinder and the lifebuoy; a delay mechanism comprising a receptacle, an annular second flange on a bottom of the receptacle, an axial hole through a center of the second flange, and an auxiliary air canister disposed in the receptacle and being in close proximity to the first needle, a hollow second cylinder having one end secured to the second flange and an opening on an other end, a disc affixed to an inner surface of the second cylinder to divide the second cylinder into a first portion defined between the disc and the second flange and a second portion defined between the disc and the main air canister, the disc having a central hole, and a main air canister disposed in the second cylinder spaced from the disc and having a bottom engaged with the opening of the second cylinder; a second needle spaced from the receptacle and moveably disposed through the central hole of the disc, the second needle being in close proximity to the main air canister; a tube put on the cap assembly and being in close proximity to the housing; a sleeve put on the tube and comprising an externally threaded end; a ring member secured onto the sleeve; a hollow third cylinder comprising a first externally threaded extension at a one end, an internally threaded cup secured to the first externally threaded extension, a second externally threaded extension at an other end, and a ring element including first internal threads secured to the externally threaded end of the sleeve, and second internal threads secured to the second externally threaded extension; a hollow anchor fastened in one end of the sleeve within the ring element; a hollow fin assembly disposed in one ends of the tube and the sleeve and being in close proximity to the anchor, the fin assembly comprising a diaphragm secured to one end of the anchor, a casing, a plurality of equally spaced slits on the casing, a plurality of spring actuated pivotal fins, and an internal biasing member biasing against the fins wherein the fins are retracted into the slits in an inoperative position; a rope having one end wound on the annular groove and an other end fastened in the anchor after passing through the tube and the fin assembly, the rope comprising an extension tied to the safety pin; and an air canister disposed in the third cylinder; wherein in response to opening the air canister, compressed air in the air canister flows to and breaks the diaphragm prior to propelling the tube out of the sleeve, the fins project out of the slits, the rope within the tube extends out of the tube to pull the safety pin out of the transverse hole, the sliding disc pushes down the first needle until the first flange engages the extension, the first needle punctures the auxiliary air canister to release compressed air from the auxiliary air canister, the compressed air enters the receptacle, the compressed air flows out of the receptacle into the first portion of the second cylinder via the axial hole, pressure in the first portion of the second cylinder increases constantly, the second needle is pushed down when the pressure reaches a predetermined value, the second needle punctures the main air canister to release compressed air from the main air canister prior to entering a second portion of the second cylinder, the compressed air flows out of the second portion of the second cylinder into the first cylinder via the opening of the second cylinder, pressure in the first cylinder increases constantly, the compressed air flows into the lifebuoy for inflation via the tubular member, the inflated lifebuoy separates the housing into the at least two pieces, and a portion of the rope wound on the annular groove unwinds.

The above and other objects, features and advantages of the invention will become apparent from the following detailed description taken with the accompanying drawings.

DETAILED DESCRIPTION OF THE INVENTION

Figure 1:
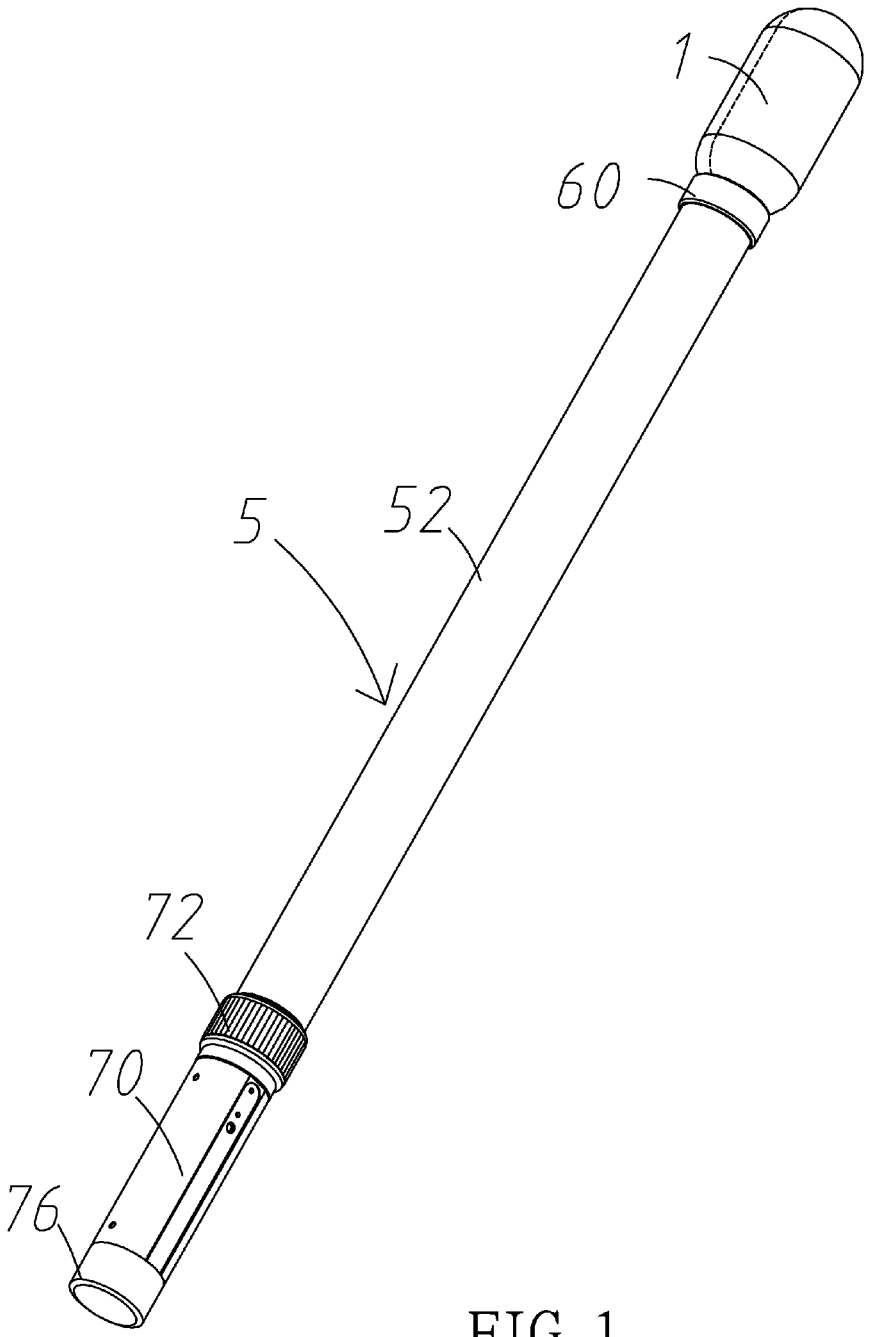
FIG. 1 is a perspective view of a life saving device according to the invention.
Figure 2:
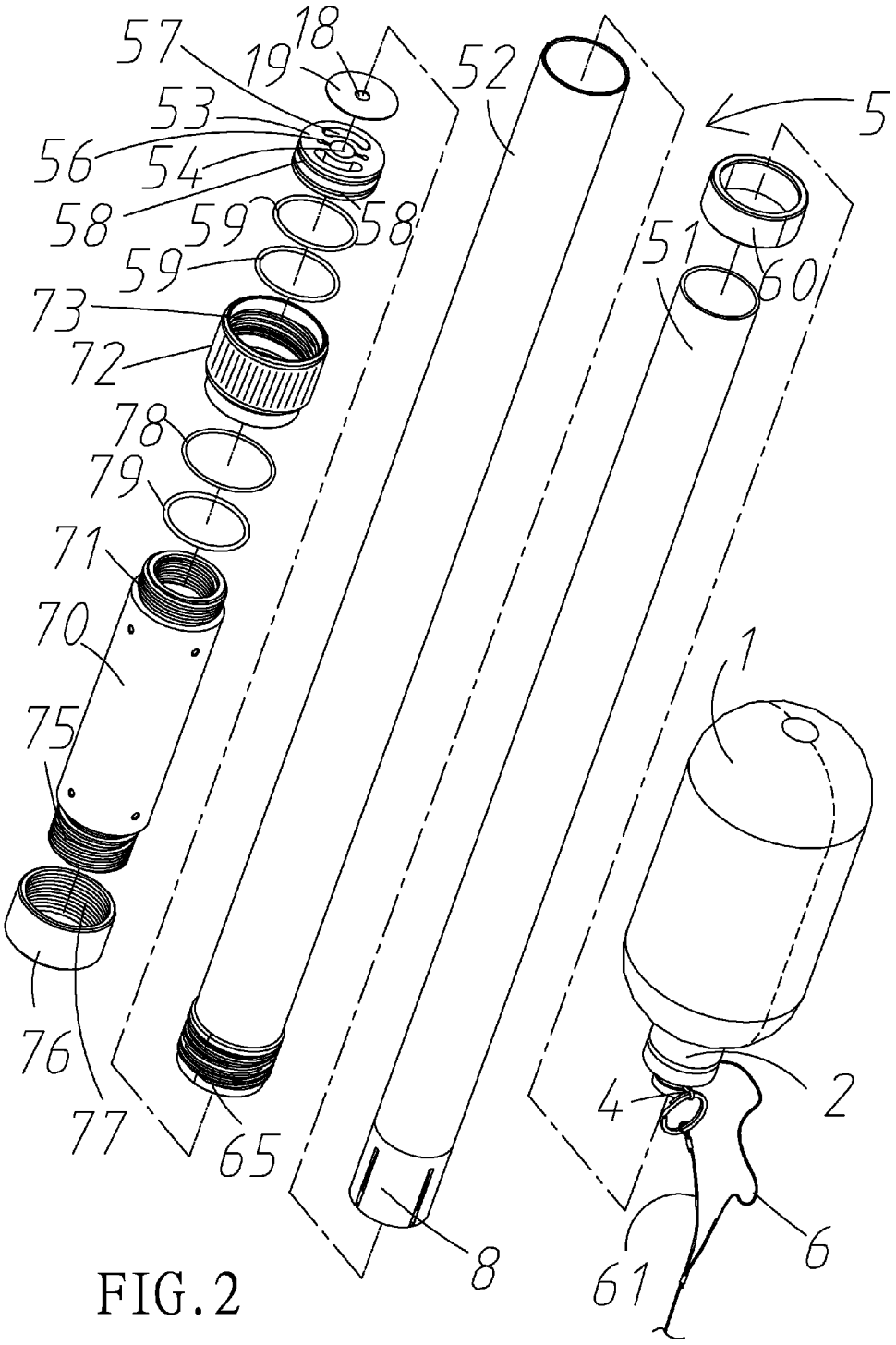
FIG. 2 is an exploded view of the life saving device of FIG. 1.
Figure 3A:
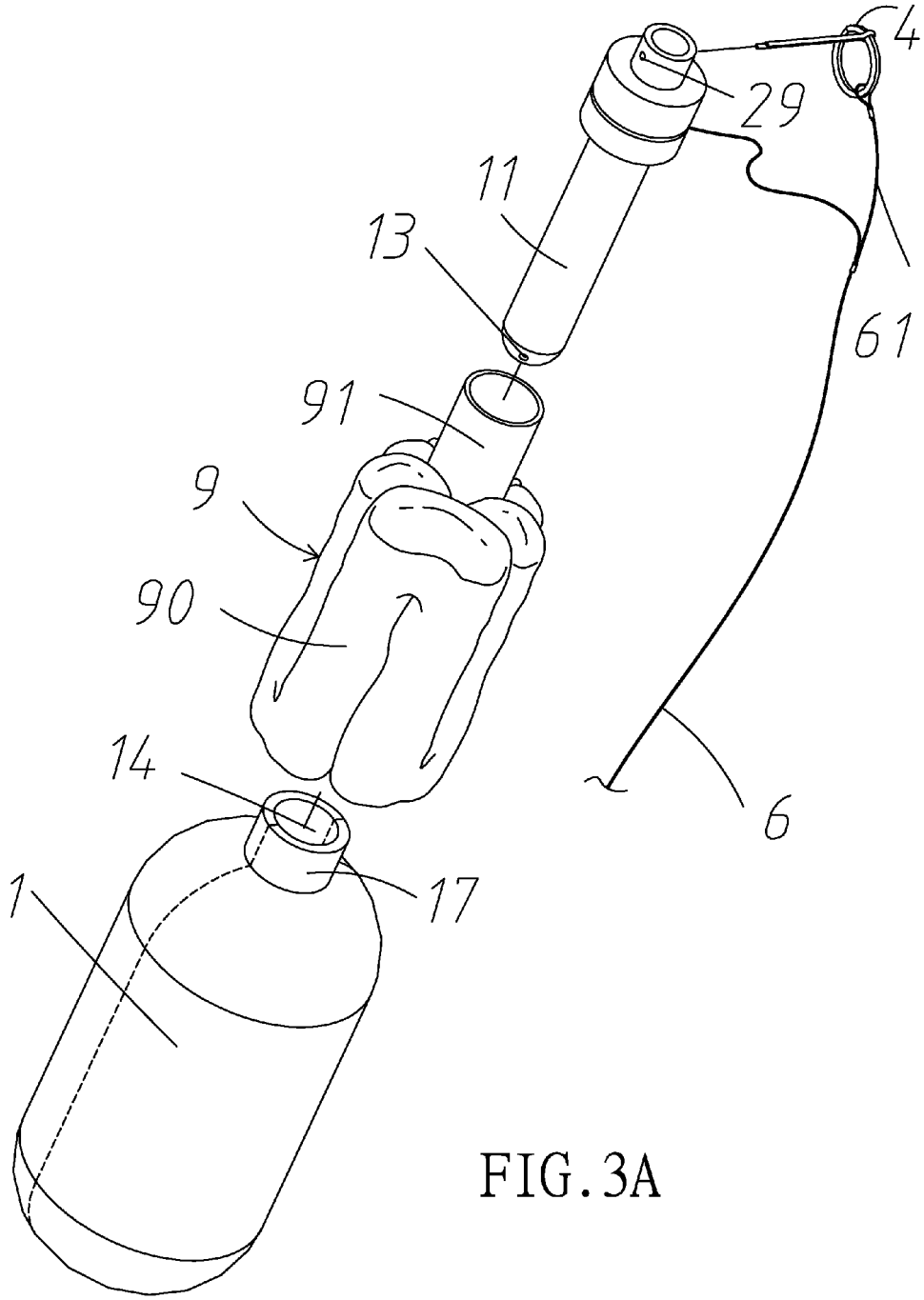
FIG. 3A is an exploded view of the projectile unit of FIG. 2
Figure 3B:
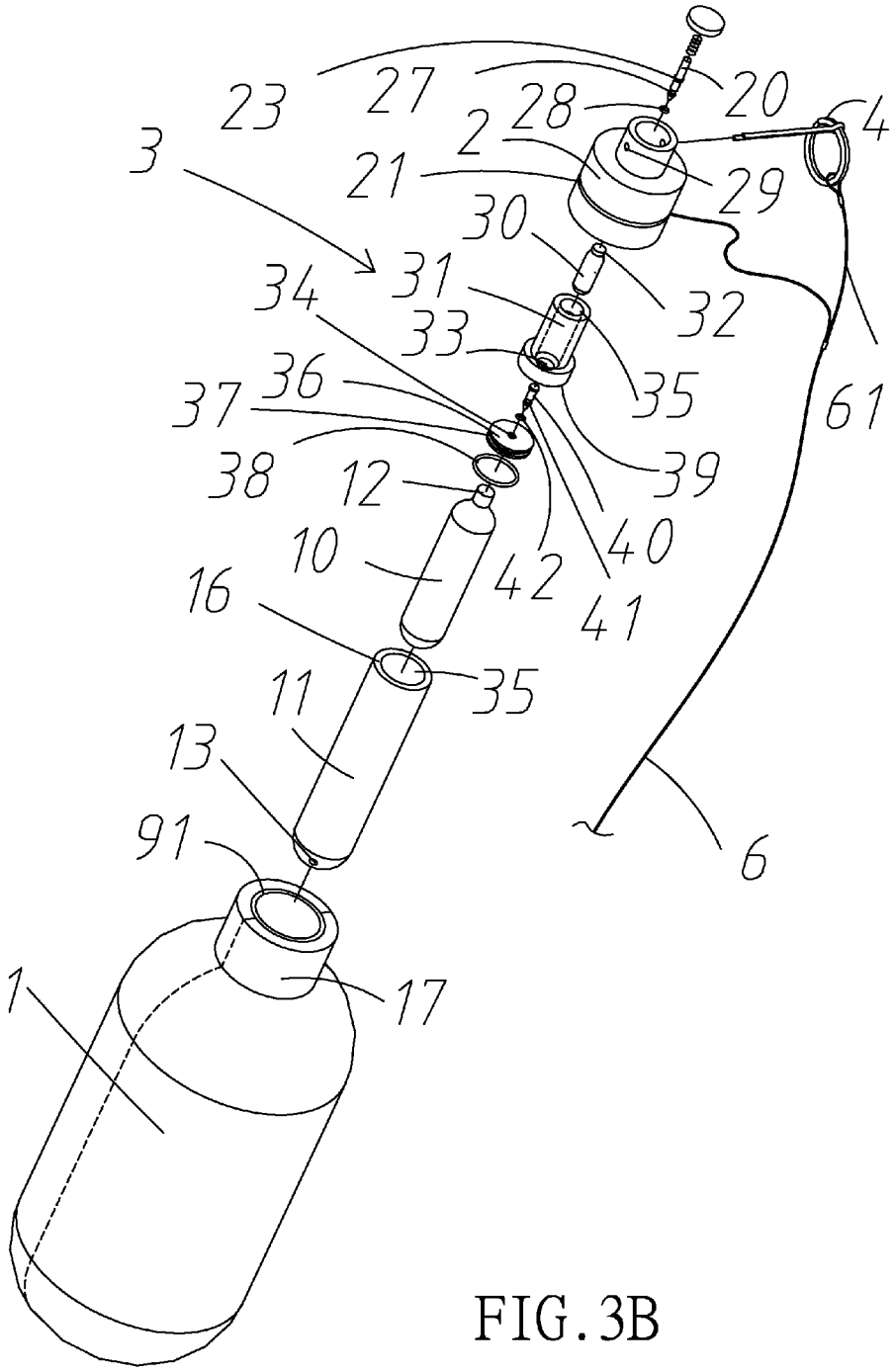
FIG. 3B is a further exploded view of FIG. 3A.

Referring to FIGS. 1 to 10, a life saving device in accordance with the invention comprises the following components as discussed in detail below.

A launching unit 5 and a projectile unit are provided. The launching unit 5 comprises the following components: A sleeve 52 is provided. A ring 60 is provided to interconnect the projectile unit and the sleeve 52.

The projectile unit comprises a housing 1 consisting of two detachable halves and comprising a cylindrical top neck 17 having an opening 14. A cylindrical cap assembly 2 comprises an annular groove 21 on an outer surface, a narrow extension 22, a disc-shaped member 24 secured to an opening of the extension 22, and a transverse hole 29 through the extension 22. A safety pin 4 is inserted through the hole 29 to support a sliding disc 26 in the extension 22. A helical spring 25 is biased between the disc-shaped member 24 and the sliding disc 26. A moveable first needle 20 is moveably provided in the cap assembly 2 and comprises an annular flange 23 proximate to the safety pin 4, an annular groove 27 proximate to a pointed end, and an O-ring 28 sealingly put on the groove 27.

A buoyant assembly 9 is provided in the housing 1 and comprises a hollow cylinder 91 having a top secured to the opening 14 and having a bottom hole 92, and an inflatable lifebuoy 90 disposed around the cylinder 91. A tubular member 15 has one end inserted into the hole 92 and the other end inserted into the surface of the lifebuoy 90. A delay mechanism 3 comprises a cylindrical receptacle 31 having an internal space 35, an annular flange 39 on a bottom of the receptacle 31, an axial hole 33 through the center of the flange 39, and an auxiliary air canister 30 disposed in the space 35 and having a top 32 in close proximity to a pointed end of the first needle 20. A hollow, cylindrical member 11 has one end secured to the flange 39 and an opening 13 on the other end. The delay mechanism 3 further comprises a disc 36 affixed to the inner surface of the cylindrical member 11 to divide the cylindrical member 11 into a first portion defined between the disc 36 and the second flange 39 and a second portion defined between the disc 36 and a main air canister 10 in the cylindrical member 11, the disc 36 having a hole 34 through its center. The main air canister 10 is provided under the disc 36 and has a bottom engaged with the opening 13.

A moveable second needle 40 is under the receptacle 31 and is disposed through the hole 34 of the disc 36. The second needle 40 comprises an annular groove 41 and an O-ring 42 sealingly put on the groove 41. The pointed end of the second needle 40 is in close proximity to a top 12 of the main air canister 10. A rope 6 has one end affixed to a member within the launching unit 5 as detailed later and the other end wound on the groove 21. The rope 6 has an extension 61 tied to the safety pin 4.

A short, hollow, cylindrical anchor 53 is provided on a lower portion of the sleeve 52. The anchor 53 comprises two opposite, curved openings 57 on one surface for allowing air to pass, an axial channel 54 for allowing the rope 6 to pass through, two opposite slits 56 formed on the mouth of the channel 54, two annular grooves 58, and two O-rings 59 fitted in the grooves 58 for sealing purpose.

A disc shaped diaphragm 19 having a central opening 18 for allowing the rope 6 to pass is provided on one surface of the anchor 53 in covering relationship to the openings 57 and the channel 54. A hollow cylinder 70 comprises a first externally threaded extension 75 at a one end, a cup 76 having internal threads 77 secured to the first externally threaded extension 75, a second externally threaded extension 71 at the other end, and a ring 72 having first internal threads 73 secured to an externally threaded extension 65 on a lower end of the sleeve 52, and second internal threads 74 secured to the second externally threaded extension 71. The cylinder 70 further comprises two sealing rings 78, 79 in which one sealing ring 79 is provided between a joining portion of the ring 72 and the second externally threaded extension 71, and the other sealing ring 78 is provided between a joining portion of the ring 72 and the externally threaded extension 65 all for sealing purposes.

A tube 51 is provided with the sleeve 52 tightly put thereon. Further, the tube 51 is tightly put on the cap assembly 2. The ring 60 is used to fasten ends of the cap assembly 2, the tube 51, and the sleeve 52 together. A fin assembly 8 is provided on lower portions of both the tube 51 and the sleeve 52 and comprises a plurality of equally spaced slits (four are shown) 34 on a housing 83, and a plurality of pivotal fins (four are shown) 88 corresponding to the slits 84 respectively. The fins 88 do not project out of the slits 84 prior to launching of the life saving device because they are pushed into the housing 83 by the inner wall of the sleeve 52 when the housing 83 is disposed in the sleeve 52. The fin assembly 8 further comprises a narrow extension 81 at one end, the extension 81 being fastened by a lower portion of the tube 51, a passage 82 through the housing 83, four wells 85 each formed on an inner surface of the housing 83 and at one end of the slit 84, four pivots 87 disposed in the wells 85, four torsion springs 86 each put on the pivot 87 so that the pivots 87 may make the fins 88 pivotal, and a helical spring 89 anchored in the passage 82 and biased against the fins 88.

The rope 6 passes the extension 81 and the passage 82 to be fastened in the channel 54. In detail, a knot 63A is formed by tying the other end of the rope 6 and is fastened in the channel 54 (see FIG. 7B). Alternatively, an anchor member 63B is provided in the channel 54 with the other end of the rope 6 being secured thereto (see FIG. 9A). Still alternatively, the anchor member 63B is replaced with a fastening member 63C (see FIG. 9B).

A rescue operation of the invention is described in detail below. First, a person may remove the cup 76, place an air canister 7 in the cylinder 70, and secure the cup 76 to the bottom of the cylinder 70.

Figure 7A:
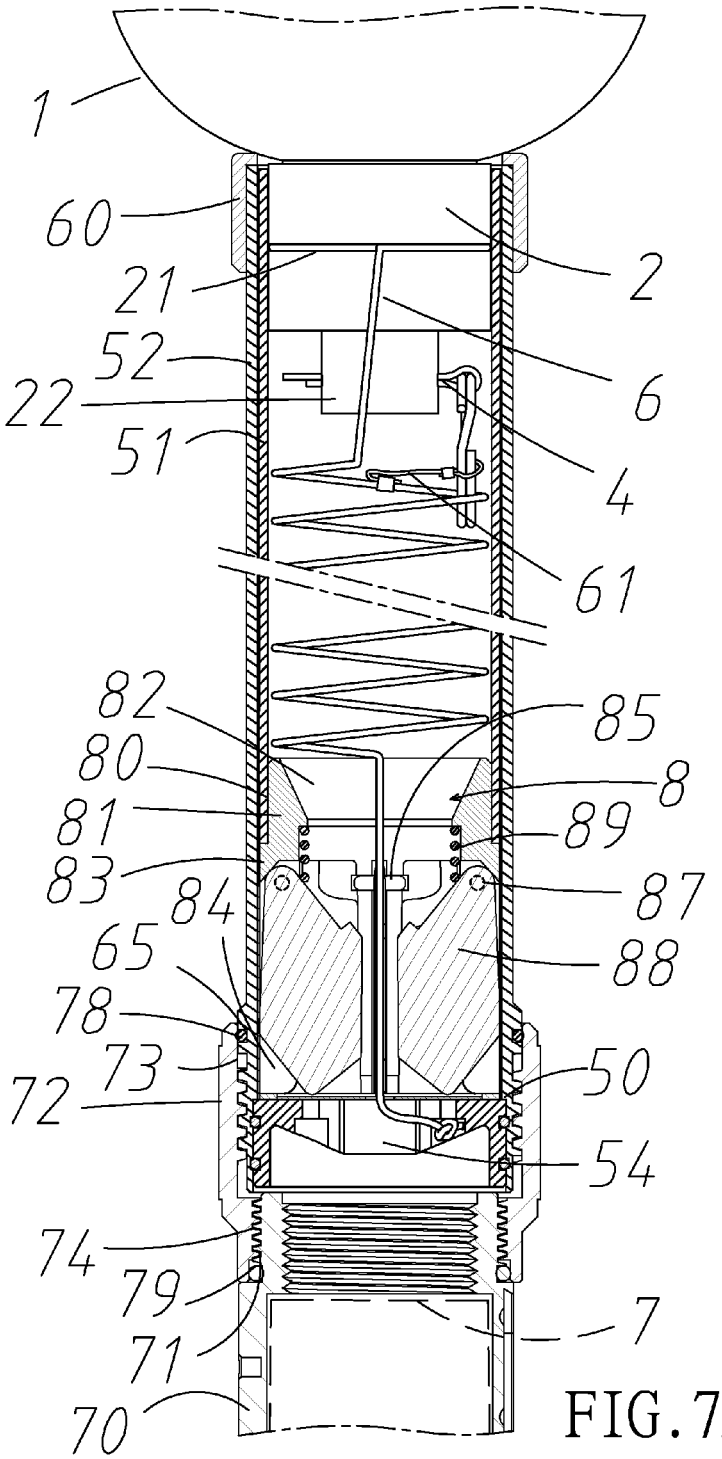
FIG. 7A is a longitudinal sectional view of a substantial portion of the launching unit.
Figure 7B:
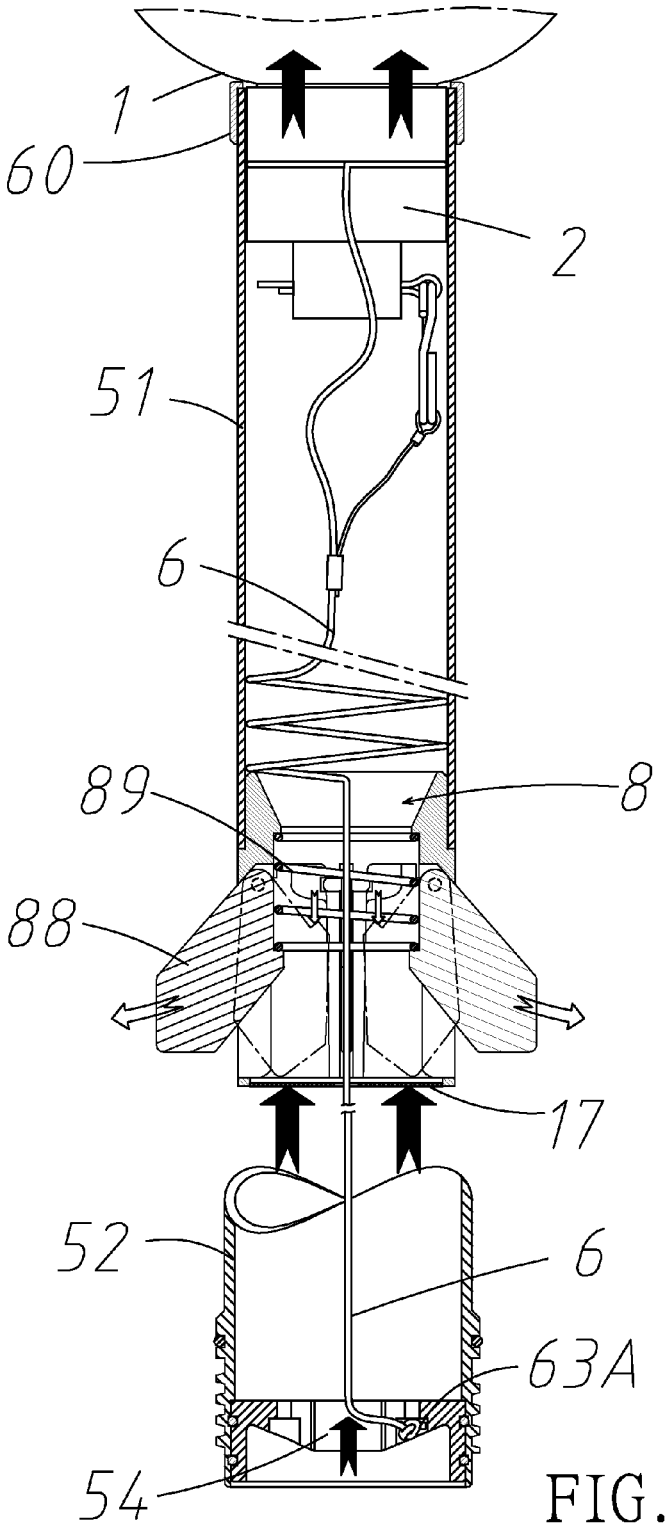
FIG. 7B is a view similar to FIG. 7A with the fins projecting out and the other end of the rope tied as a knot fastened in the anchor.
Figure 8A:
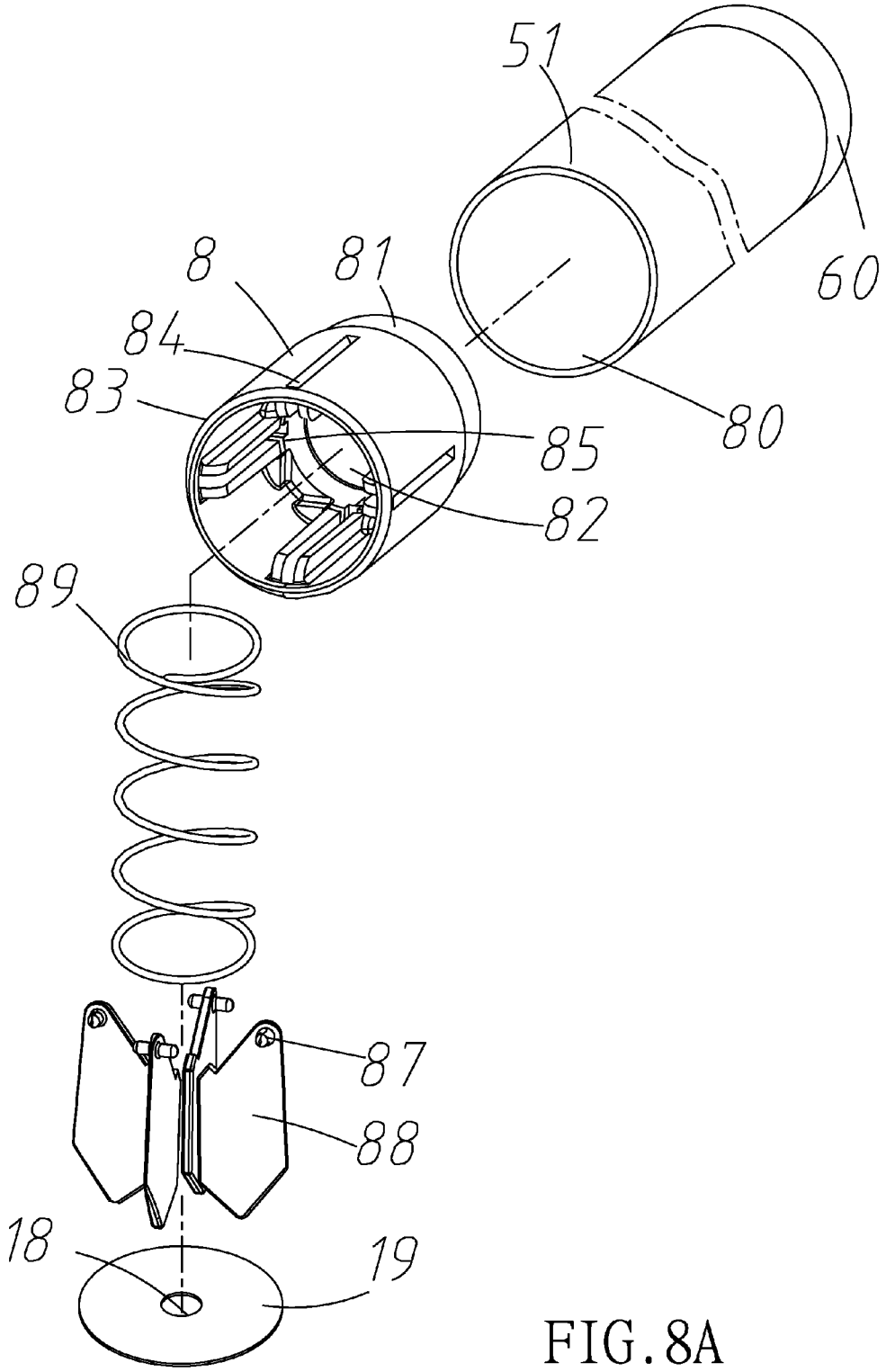
FIG. 8A is an exploded view of the fin assembly.
Figure 8B:
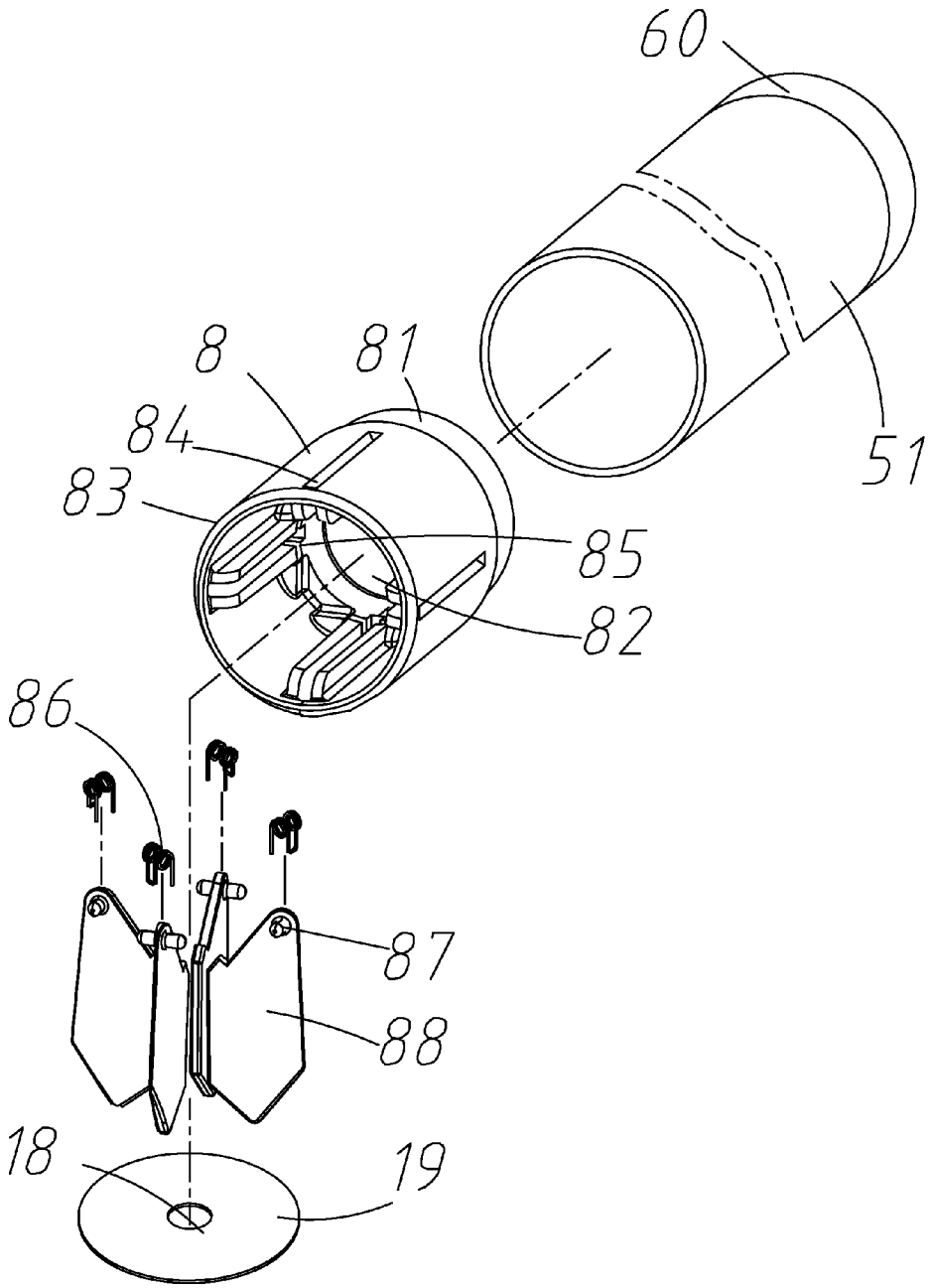
FIG. 8B is a further exploded view of FIG. 8A.
Figure 9A:
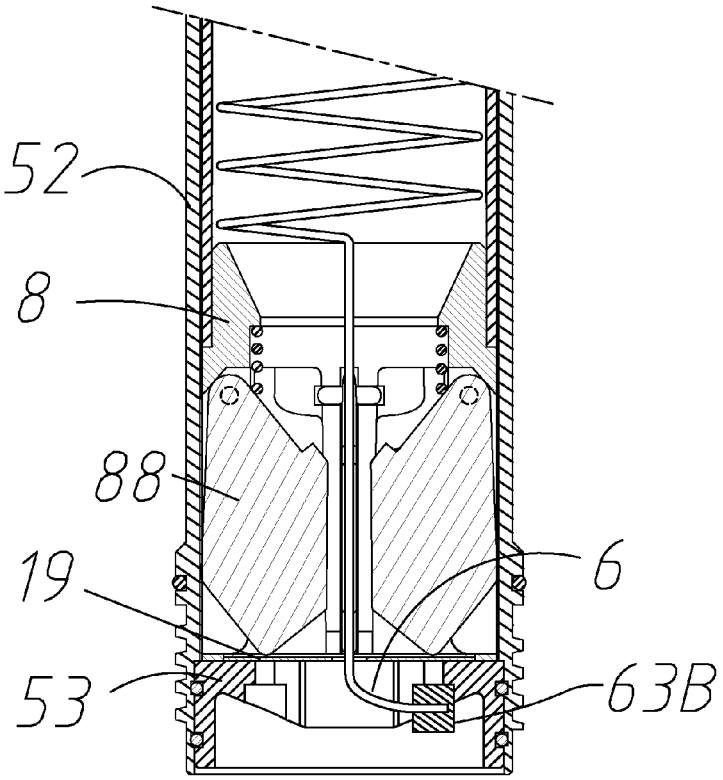
FIG. 9A is a longitudinal sectional view of the fin assembly showing an anchor member in the anchor for fastening the other end of the rope.
Figure 9B:
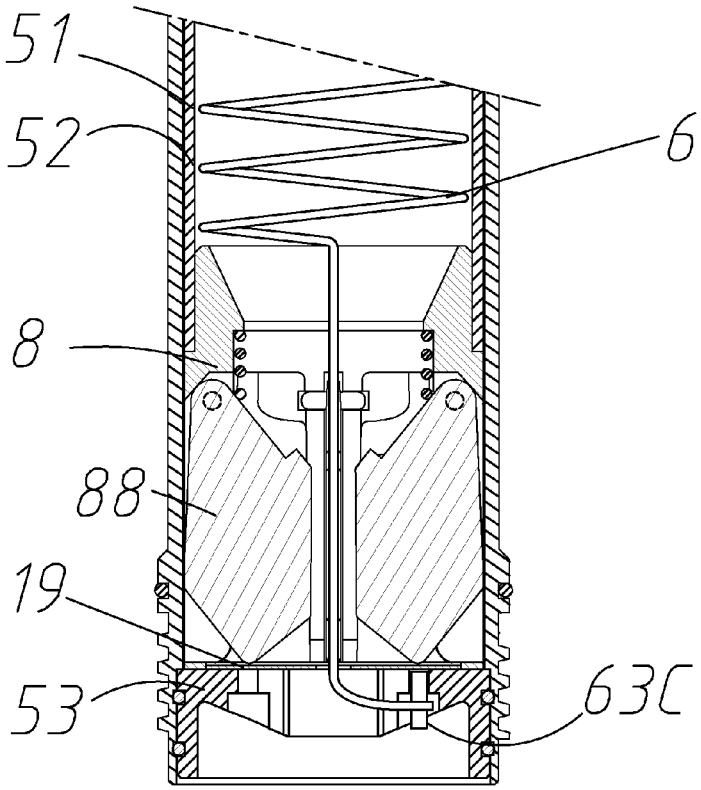
FIG. 9B is a view similar to FIG. 9A showing a fastening member as a replacement of the anchor member for fastening the other end of the rope.
Figure 10:
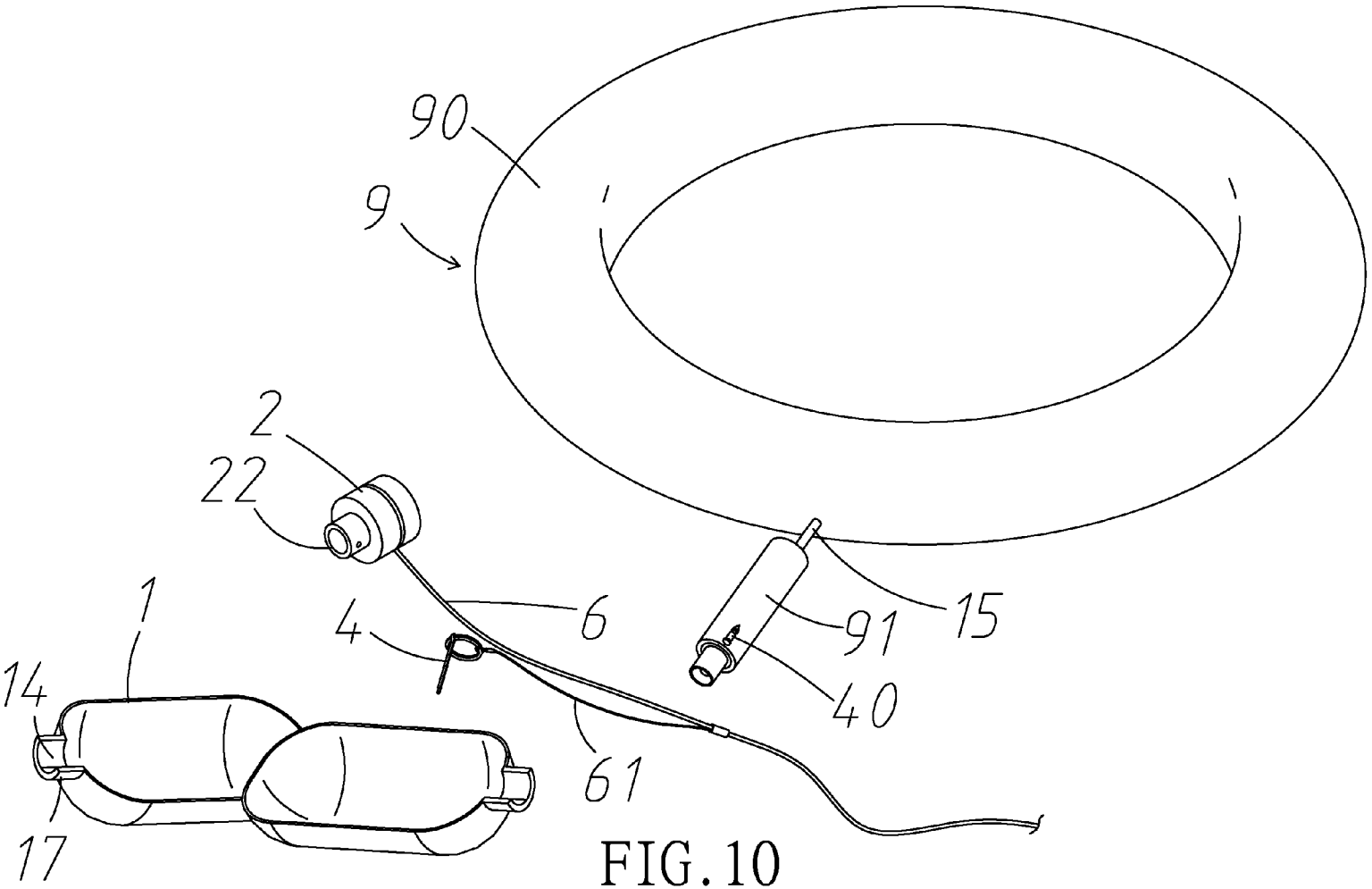
FIG. 10 schematically depicts a final phase with the lifebuoy being expanded and the housing being split into two halves.

As shown in FIGS. 7A and 7B, a user may open the air canister 7 to cause compressed air in the air canister 7 to strongly flow to the diaphragm 19 to break the diaphragm 19. And in turn, the compressed air propels the tube 51 out of the sleeve 52. The fins 88 extend out of the slits 84 due to expansion of the spring 89 after leaving the sleeve 52. The extended fins 88 can stabilize the flight of the tube 51 and the projectile unit including housing 1. The rope 6 gradually extends out of a rear end of the tube 51 during the flight of the tube 51.

Figure 4A:
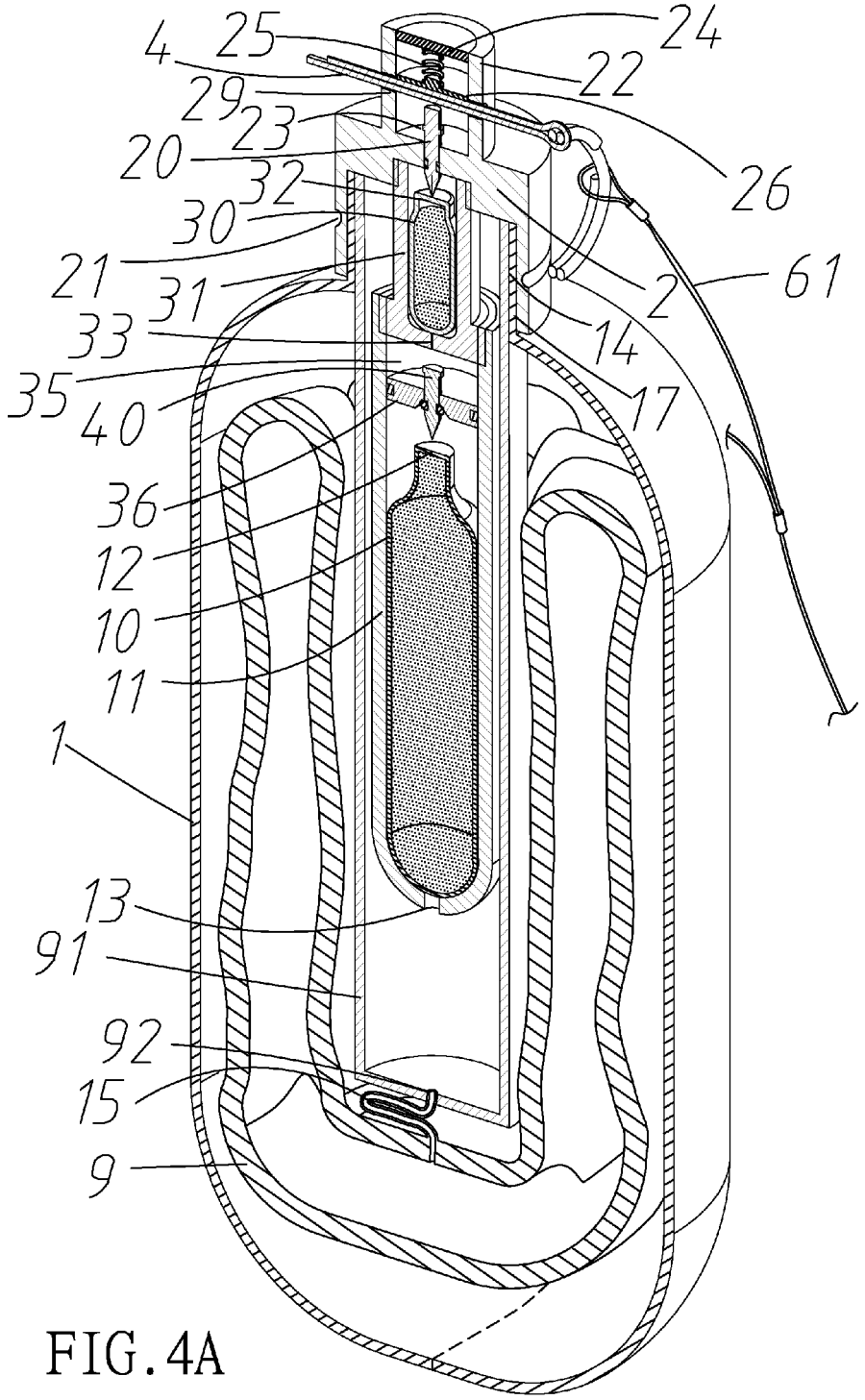
FIG. 4A is a longitudinal section of the projectile unit of FIG. 1 prior to trigger.
Figure 4B:
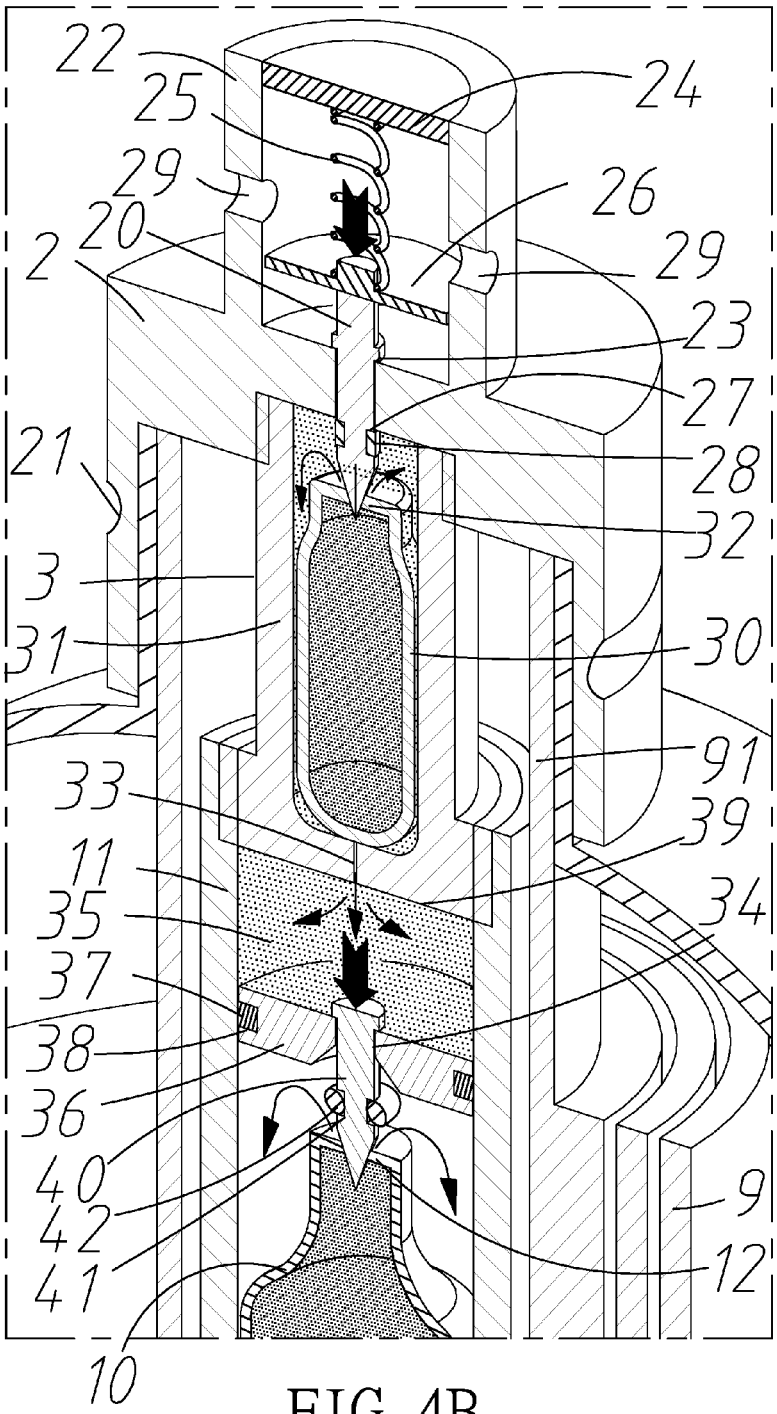
FIG. 4B is a detailed view showing the first needle piercing the auxiliary air canister and the second needle piercing the main air canister in an initial phase.
Figure 5A:
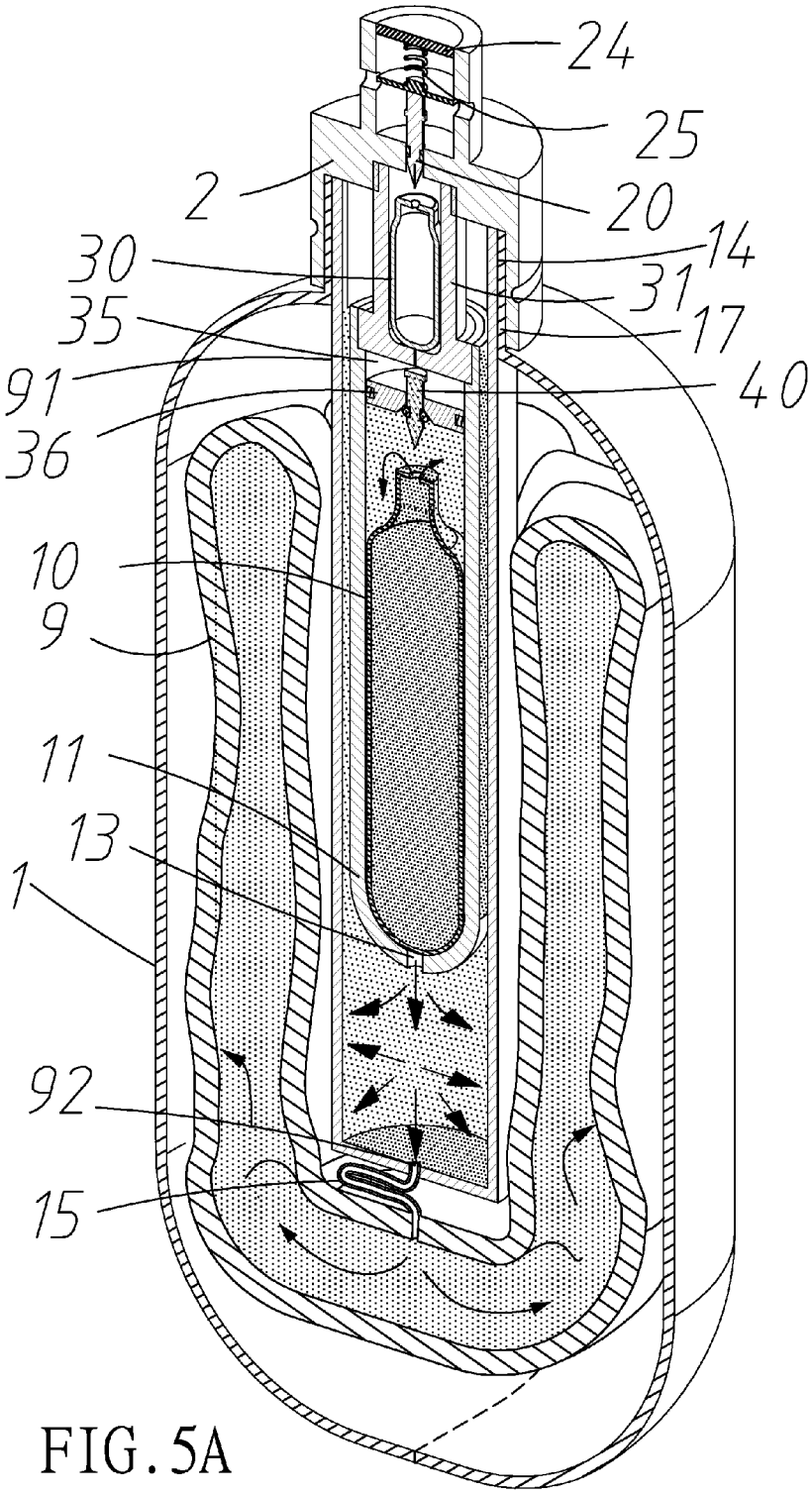
FIG. 5A is a view similar to FIG. 4A showing the first needle clearing the auxiliary air canister and the second needle clearing the main air canister in an intermediate phase.
Figure 5B:
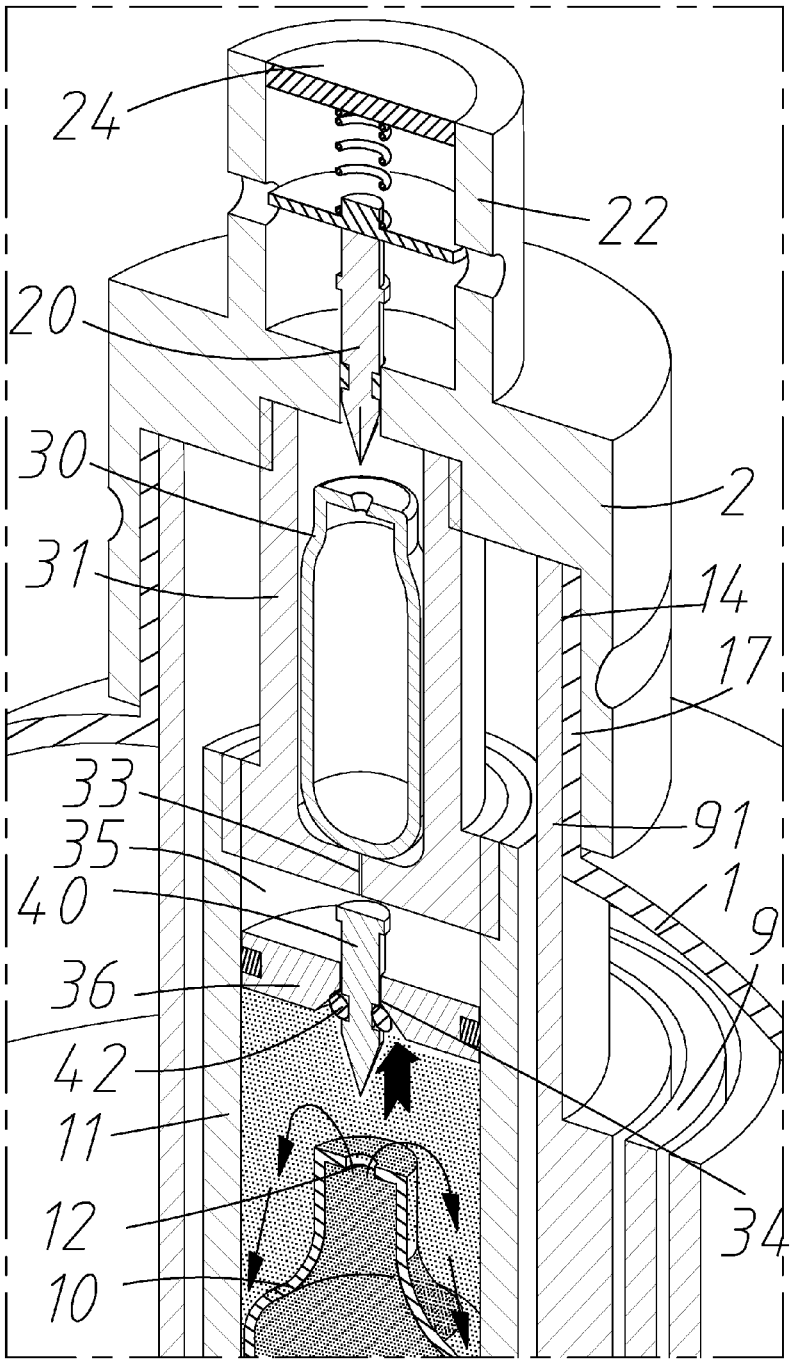
FIG. 5B is a detailed view of an upper part of FIG. 5A.
Figure 6:
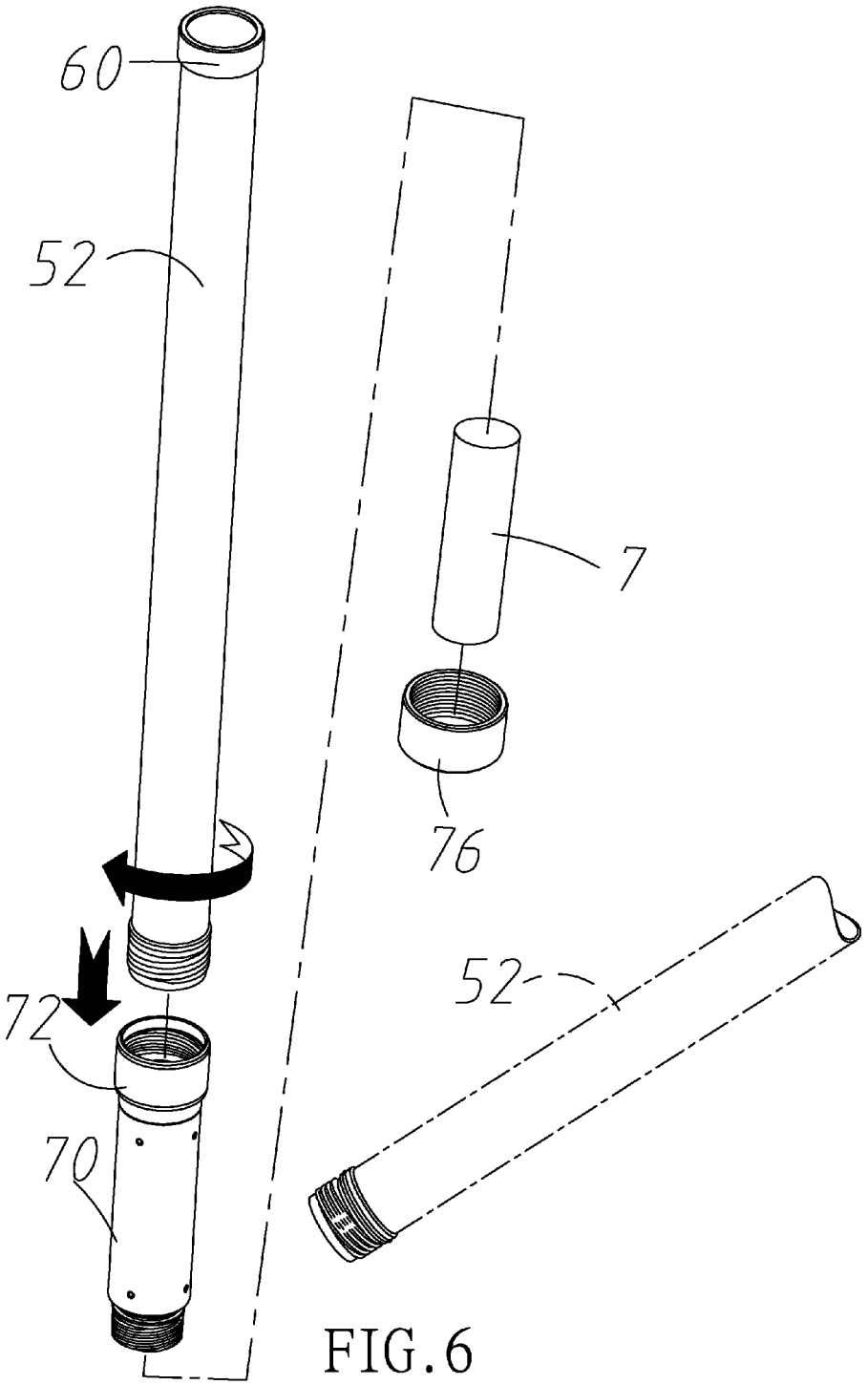
FIG. 6 is an exploded view of the launching unit of the life saving device of FIG. 1.

As shown in FIGS. 4B, 5A, and 5B, after a period of flying time, the extending rope 6 pulls the safety pin 4 out of the hole 29. The energized spring 25 expands to push down the sliding disc 26 which in turn pushes down the first needle 20 until the flange 23 engages a bottom of the extension 22 (i.e., being stopped). The pointed end of the first needle 20 thus punctures the top 32 of the auxiliary air canister 30 to release compressed air from the auxiliary air canister 30 prior to entering the receptacle 31. The compressed air flows out of the receptacle 31 into the space 35 via the hole 33. The pressure in the space 35 increases constantly and will push down the second needle 40 when the pressure reaches a predetermined value. The pointed end of the second needle 40 punctures the top 12 of the main air canister 10 to release compressed air from the main air canister 10 prior to entering the cylindrical member 11. The compressed air flows out of the cylindrical member 11 into the cylinder 91 via the opening 13. The pressure in the cylinder 91 increases constantly and the compressed air flows into the lifebuoy 90 for inflation via the tubular member 15. The inflated lifebuoy 90 finally separates the housing 1 into two halve and the portion of the rope 6 wound on the groove 21 unwinds. Finally, the lifebuoy 90 reaches a person being overwhelmed in water.

While the invention has been described in terms of preferred embodiments, those skilled in the art will recognize that the invention can be practiced with modifications within the spirit and scope of the appended claims.

What is claimed is:

1. A life saving device comprising:

a housing consisting of at least two detachable pieces and comprising a neck having an opening;

a cylindrical cap assembly comprising an annular groove on an outer surface, a hollow extension, a stop member secured to an opening of the extension, a transverse hole through the extension, a safety pin inserted through the transverse hole, and a spring biased sliding disc having one end secured to the stop member and an other end urging against the safety pin;

a first needle moveably disposed in the cap assembly and comprising an annular first flange proximate to the safety pin;

a buoyant assembly disposed in the housing and comprising a hollow first cylinder having a top secured to the opening of the neck and including an inflatable lifebuoy disposed around the first cylinder;

a tubular member being in fluid communication with both the first cylinder and the lifebuoy;

a delay mechanism comprising a receptacle, an annular second flange on a bottom of the receptacle, an axial hole through a center of the second flange, and an auxiliary air canister disposed in the receptacle and being in close proximity to the first needle, a hollow second cylinder having one end secured to the second flange and an opening on an other end, a disc affixed to an inner surface of the second cylinder to divide the second cylinder into a first portion defined between the disc and the second flange and a second portion defined between the disc and the main air canister, the disc having a central hole, and a main air canister disposed in the second cylinder spaced from the disc and having a bottom engaged with the opening of the second cylinder;

a second needle spaced from the receptacle and moveably disposed through the central hole of the disc, the second needle being in close proximity to the main air canister;

a tube put on the cap assembly and being in close proximity to the housing;

a sleeve put on the tube and comprising an externally threaded end;

a ring member secured onto the sleeve;

a hollow third cylinder comprising a first externally threaded extension at a one end, an internally threaded cup secured to the first externally threaded extension, a second externally threaded extension at an other end, and a ring element including first internal threads secured to the externally threaded end of the sleeve, and second internal threads secured to the second externally threaded extension;

a hollow anchor fastened in one end of the sleeve within the ring element;

a hollow fin assembly disposed in one ends of the tube and the sleeve and being in close proximity to the anchor, the fin assembly comprising a diaphragm secured to one end of the anchor, a casing, a plurality of equally spaced slits on the casing, a plurality of spring actuated pivotal fins, and an internal biasing member biasing against the fins wherein the fins are retracted into the slits in an inoperative position;

a rope having one end wound on the annular groove and an other end fastened in the anchor after passing through the tube and the fin assembly, the rope comprising an extension tied to the safety pin; and an air canister disposed in the third cylinder;

wherein in response to opening the air canister, compressed air in the air canister flows to and breaks the diaphragm prior to propelling the tube out of the sleeve, the fins project out of the slits, the rope within the tube extends out of the tube to pull the safety pin out of the transverse hole, the sliding disc pushes down the first needle until the first flange engages the extension, the first needle punctures the auxiliary air canister to release compressed air from the auxiliary air canister, the compressed air enters the receptacle, the compressed air flows out of the receptacle into the first portion of the second cylinder via the axial hole, pressure in the first portion of the second cylinder increases constantly, the second needle is pushed down when the pressure reaches a predetermined value, the second needle punctures the main air canister to release compressed air from the main air canister prior to entering a second portion of the second cylinder, the compressed air flows out of the second portion of the second cylinder into the first cylinder via the opening of the second cylinder, pressure in the first cylinder increases constantly, the compressed air flows into the lifebuoy for inflation via the tubular member, the inflated lifebuoy separates the housing into the at least two pieces, and a portion of the rope wound on the annular groove unwinds.

* * * * *